US009303576B2

(12) United States Patent
Hashemi

(10) Patent No.: US 9,303,576 B2
(45) Date of Patent: Apr. 5, 2016

(54) METHOD FOR CONTROLLING AN ENGINE

(75) Inventor: Sam Hashemi, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 930 days.

(21) Appl. No.: 13/404,937

(22) Filed: Feb. 24, 2012

(65) Prior Publication Data

US 2013/0226439 A1 Aug. 29, 2013

(51) Int. Cl.

| | |
|---|---|
| ***F02D 41/00*** | (2006.01) |
| ***F02D 41/02*** | (2006.01) |
| ***F02N 11/04*** | (2006.01) |
| *F02D 41/04* | (2006.01) |
| *F02N 11/08* | (2006.01) |
| *F02N 19/00* | (2010.01) |

(52) U.S. Cl.

CPC ..... *F02D 41/0295* (2013.01); *F02N 11/04* (2013.01); *F02D 41/042* (2013.01); *F02N 11/0814* (2013.01); *F02N 2019/008* (2013.01)

(58) Field of Classification Search

CPC ... F02D 41/0295; F02D 41/042; F02N 11/04; F02N 11/0814; F02N 2019/008

USPC ..... 701/108, 109, 112

See application file for complete search history.

(56) References Cited

U.S. PATENT DOCUMENTS

| | | | | |
|---|---|---|---|---|
| 6,173,569 | B1 * | 1/2001 | Kusada et al. | 60/277 |
| 6,321,530 | B1 * | 11/2001 | Hoshi et al. | 60/274 |
| 6,327,852 | B1 * | 12/2001 | Hirose | 60/297 |
| 6,397,963 | B1 * | 6/2002 | Lennevi | 180/65.235 |
| 6,581,373 | B2 * | 6/2003 | Suzuki et al. | 60/285 |
| 6,700,213 | B1 * | 3/2004 | Wakashiro et al. | 290/40 C |
| 6,742,327 | B2 * | 6/2004 | Inoue et al. | 60/285 |
| 7,055,312 | B2 * | 6/2006 | Osawa et al. | 60/285 |
| 7,198,952 | B2 * | 4/2007 | Uchida et al. | 436/37 |
| 7,469,530 | B2 * | 12/2008 | Fujiwara et al. | 60/285 |
| 7,487,852 | B2 * | 2/2009 | Leone et al. | 180/65.28 |
| 7,599,786 | B2 * | 10/2009 | Utsumi et al. | 701/112 |
| 7,653,478 | B2 | 1/2010 | Park | |
| 7,997,365 | B2 * | 8/2011 | Muta | 180/65.28 |
| 8,181,452 | B2 * | 5/2012 | Bidner et al. | 60/295 |
| 8,326,519 | B2 * | 12/2012 | McDonald et al. | 701/112 |
| 8,402,751 | B2 * | 3/2013 | Bidner et al. | 60/295 |
| 2002/0052266 | A1 * | 5/2002 | Suzuki et al. | 477/102 |
| 2003/0046927 | A1 * | 3/2003 | Nagai et al. | 60/285 |
| 2004/0060535 | A1 * | 4/2004 | Osawa et al. | 123/198 DB |
| 2004/0194452 | A1 * | 10/2004 | Inoue et al. | 60/286 |
| 2005/0193722 | A1 * | 9/2005 | Fujiwara et al. | 60/285 |
| 2008/0149405 | A1 | 6/2008 | Hladun et al. | |
| 2009/0008165 | A1 * | 1/2009 | Muta | 180/65.2 |
| 2009/0025371 | A1 * | 1/2009 | Hermansson et al. | 60/286 |
| 2009/0205889 | A1 * | 8/2009 | Leone | 180/65.265 |
| 2010/0174468 | A1 * | 7/2010 | Surnilla et al. | 701/103 |
| 2010/0204908 | A1 | 8/2010 | Nakai | |
| 2011/0072791 | A1 * | 3/2011 | Bidner et al. | 60/278 |
| 2011/0072792 | A1 * | 3/2011 | Bidner et al. | 60/278 |

(Continued)

*Primary Examiner* — Hieu T Vo
*Assistant Examiner* — Sherman Manley
(74) *Attorney, Agent, or Firm* — Julia Voutyras; Alleman Hall McCoy Russell & Tuttle LLP

(57) ABSTRACT

Methods and systems for controlling an engine that may be automatically stopped and started are presented. In one example, a method adjusts an amount of current to an electric device applying torque to an engine to adjust an amount of air that is pumped through the engine to a catalyst. The methods and systems may reduce engine emissions.

19 Claims, 5 Drawing Sheets

(56) References Cited

U.S. PATENT DOCUMENTS

2011/0072793 A1* 3/2011 Bidner et al. ..... 60/285
2011/0072802 A1* 3/2011 Bidner et al. ..... 60/287
2012/0017870 A1* 1/2012 Surnilla et al. ..... 123/339.14
2012/0227382 A1* 9/2012 Bidner et al. ..... 60/274

* cited by examiner

METHOD FOR CONTROLLING AN ENGINE

FIELD

The present description relates to methods and systems for controlling an engine that may be automatically stopped and started. The methods and systems may be particularly useful to reduce engine emissions related to restarting an automatically stopped engine.

BACKGROUND AND SUMMARY

While a vehicle is traveling in congested traffic it may be desirable to stop the vehicle's engine to conserve fuel. However, stopping an engine can cause air to be pumped through a catalyst positioned downstream of the engine. The air in the catalyst may allow higher levels of NOx to be released from the vehicle's exhaust system. On the other hand, it may be desirable to pump some oxygen into the catalyst so that oxygen is available to oxidize hydrocarbons when the engine is restarted. Thus, there may be conflicting requirements as to whether or not it is desirable to pump air through the engine during engine stopping.

The inventor herein has recognized the above-mentioned disadvantages associated with frequent automatic engine stopping and starting and has developed a method for operating an engine, comprising: shutting down an engine; and adjusting current supplied to an electric device applying torque to a crankshaft of the engine in response to an oxygen storage capacity of a catalyst at a time of shutting down the engine.

By adjusting current supplied to an electric device applying torque to a crankshaft of an engine, it may be possible to better control an amount of air that is pumped into a catalyst when an engine is stopped. For example, if the catalyst has a high oxygen storage capacity and a low amount of oxygen stored in the catalyst at a time when an engine stop is requested, the engine may be allowed to rotate a predetermined first number of times from initiation of the engine stop to the time engine speed is zero. Alternatively, if the catalyst has a high oxygen storage capacity and a large portion of the available oxygen storage capacity is utilized at the time of an engine stop request, the engine may be allowed to rotate a predetermined second number of times from initiation of the engine stop request to the time engine speed is zero. In one example, the second number is smaller than the first number so that less air may be pumped through the catalyst by the engine when a large portion of the catalyst's oxygen storage capacity is utilized. In this way, engine stopping can be controlled to adjust the operating state of the catalyst in preparation for an engine restart.

The present description may provide several advantages. Specifically, the approach may reduce engine emissions during engine starting. Additionally, the approach may be applicable to a variety of electrical machines that work with the engine. For example, the approach may be implemented with a starter that is engaged via a pinion. Further, the approach may be implemented with an integrated starter/alternator that is coupled to the engine's crankshaft via a belt. Further still, the approach may be applicable to a system where an electric machine is mechanically coupled directly to the engine crankshaft.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example, referred to herein as the Detailed Description, when taken alone or with reference to the drawings, where.

DETAILED DESCRIPTION

Figure 1:
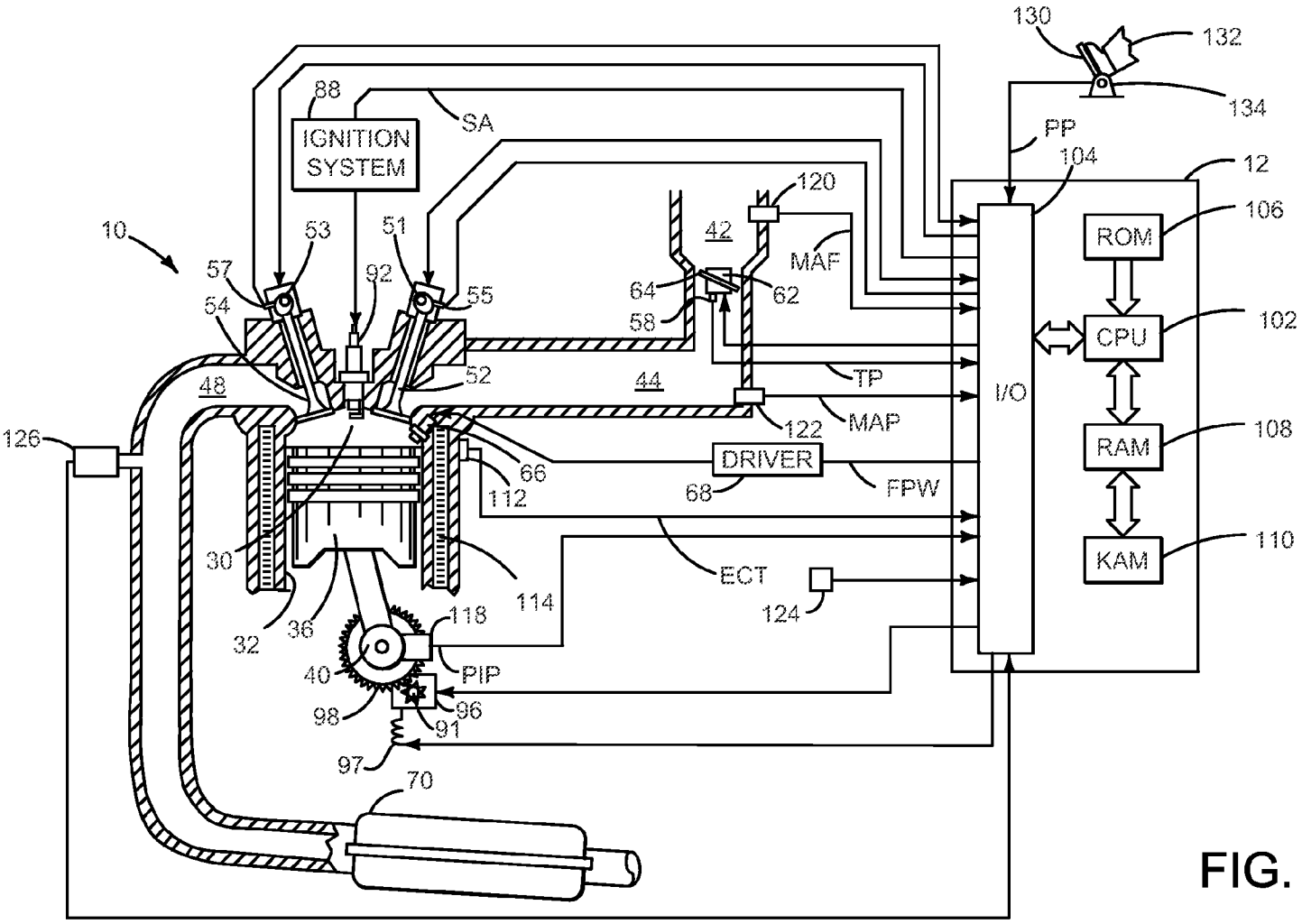
FIG. 1 is a schematic diagram of an engine.
Figure 2:
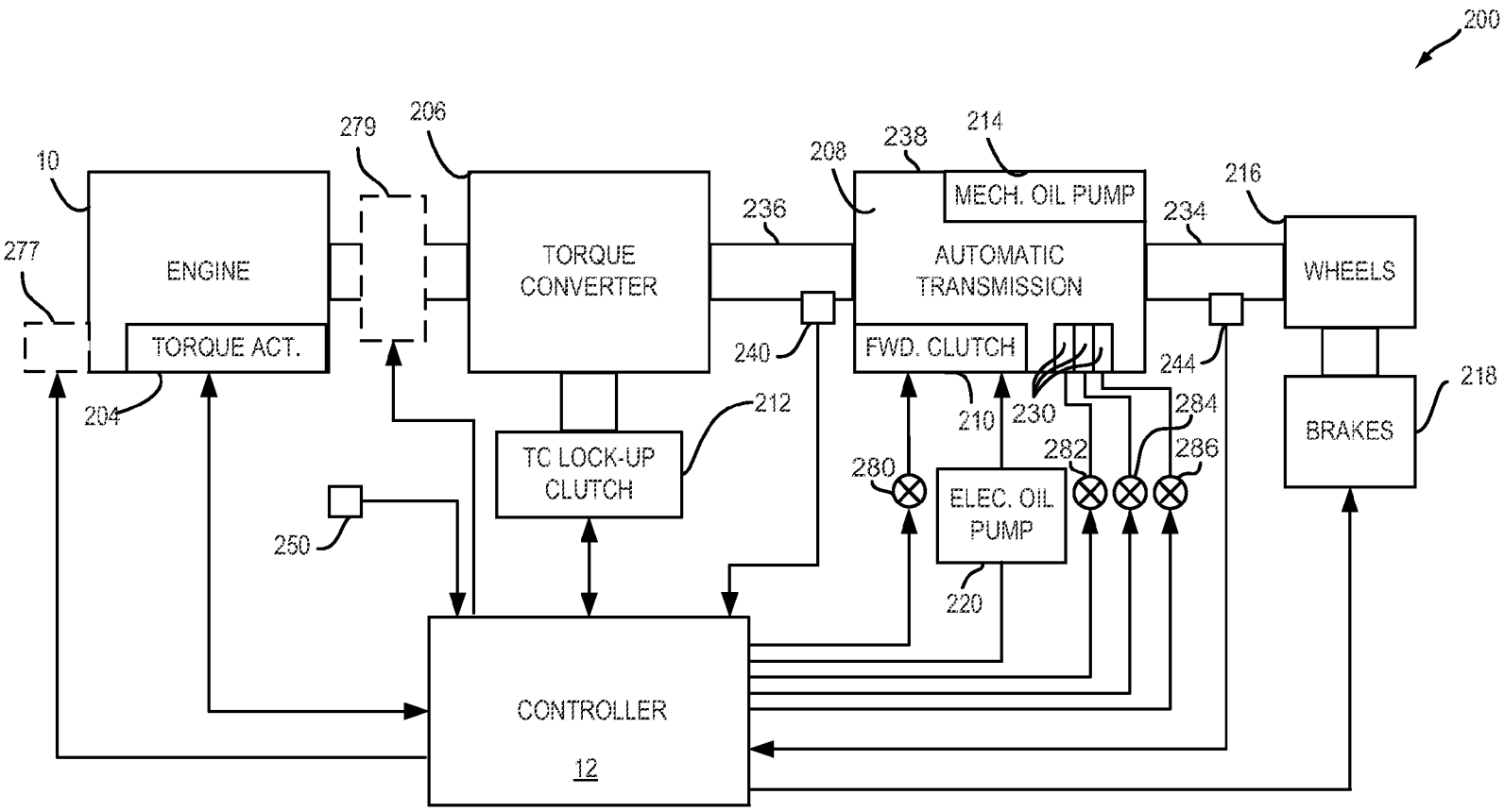
FIG. 2 is shows an example powertrain system layout.
Figure 3:
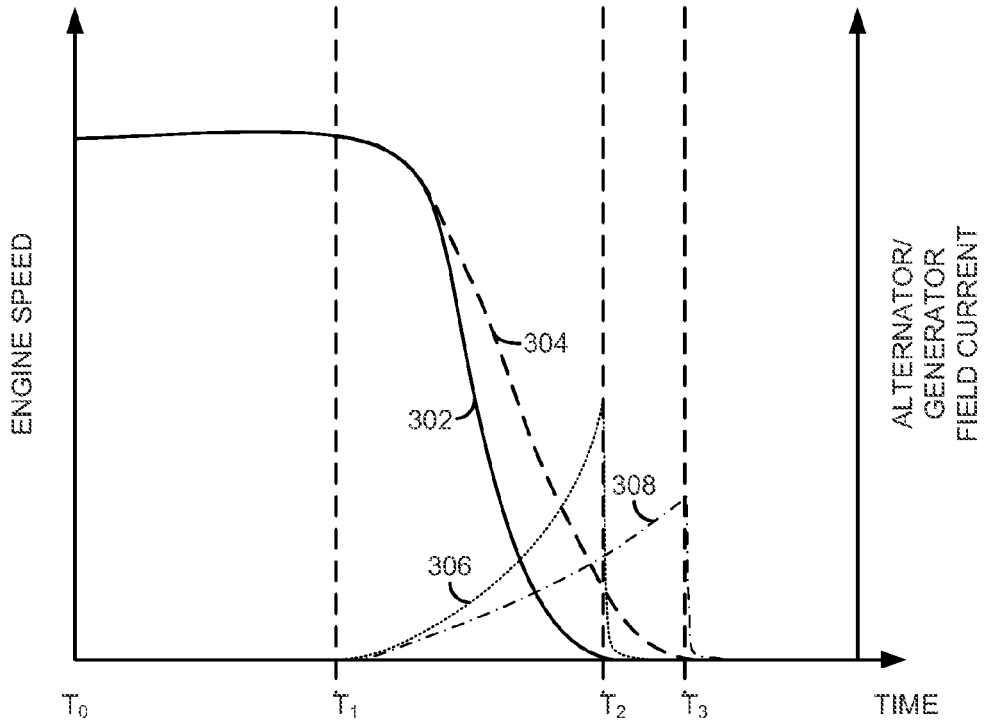
FIGS. 3-4 are example plots of engine speed during engine stopping.
Figure 4:
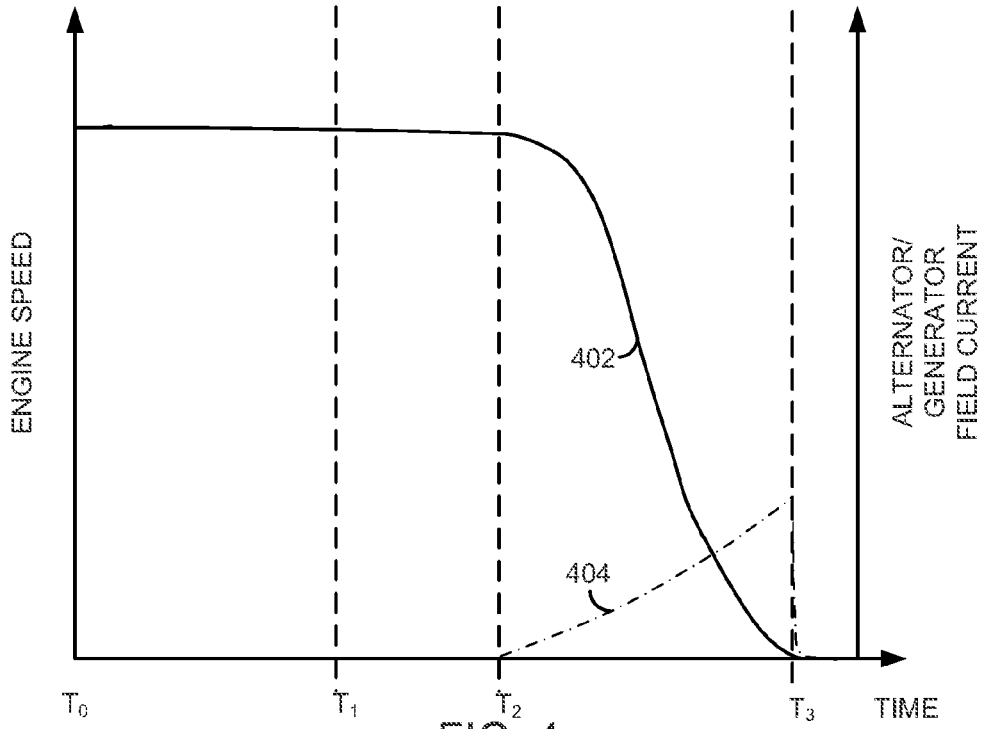

The present description is related to controlling an engine that may be automatically stopped and started. In one non-limiting example, the engine may be configured as illustrated in FIG. 1. Further, the engine may be part of a vehicle powertrain as illustrated in FIG. 2. Engine stopping may be performed according to the method described by FIGS. 5 and 6. The method of FIGS. 5 and 6 may be used to control an engine as shown in FIGS. 3 and 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic air inlet throttle 62 which adjusts a position of air inlet throttle plate 64 to control air flow from air intake 42 to intake manifold 44. In one example, a high pressure, dual stage, fuel system may be used to generate higher fuel pressures.

Ignition coil 88 provides an ignition spark to combustion chamber 30 via spark plug 92 in response to a signal from controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Engine starter 96 may selectively engage flywheel 98 which is coupled to crankshaft 40 to rotate crankshaft 40. Engine starter 96 may be engaged via a signal from controller 12. In some examples, engine starter 96 may be engaged without input from a driver dedicated engine stop/start command input (e.g., a key switch or pushbutton). Rather, engine starter 96 may be engaged via pinion 91 when a driver releases a brake pedal or depresses accelerator pedal 130 (e.g., an input device that does not have a sole purpose of stopping and/or starting the engine). In this way, engine 10 may be automatically started via engine starter 96 to conserve fuel.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; barometric pressure from sensor 124; and a measurement of air inlet throttle position from sensor 58. In a preferred aspect of the present description, engine position sensor 118 produces a predetermined number of equally spaced pulses every revolution of the crankshaft from which engine speed (RPM) can be determined. Controller 12 also adjusts current to field coil 97 to control torque applied by starter 96 to crankshaft 40.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a block diagram of a vehicle drive-train 200. Drive-train 200 may be powered by engine 10. Engine 10 may be started with an engine starting system as shown in FIG. 1 or via belt driven starter/alternator 277 or motor/generator 279. Further, engine 10 may generate or adjust torque via torque actuator 204, such as a fuel injector, air inlet throttle, etc.

An engine output torque may be transmitted to torque converter 206 to drive an automatic transmission 208 via transmission input shaft 236. Further, one or more clutches may be engaged, including forward clutch 210 and gear clutches 230, to propel a vehicle. In one example, the torque converter may be referred to as a component of the transmission. Further, transmission 208 may include a plurality of gear clutches 230 that may be engaged as needed to activate a plurality of fixed transmission gear ratios. The output of the torque converter may in turn be controlled by torque converter lock-up clutch 212. For example, when torque converter lock-up clutch 212 is fully disengaged, torque converter 206 transmits engine torque to automatic transmission 208 via fluid transfer between the torque converter turbine and torque converter impeller, thereby enabling torque multiplication. In contrast, when torque converter lock-up clutch 212 is fully engaged, the engine output torque is directly transferred via the torque converter clutch to an input shaft 236 of transmission 208. Alternatively, the torque converter lock-up clutch 212 may be partially engaged, thereby enabling the amount of torque relayed to the transmission to be adjusted. A controller 12 may be configured to adjust the amount of torque transmitted by torque converter 212 by adjusting the torque converter lock-up clutch in response to various engine operating conditions, or based on a driver-based engine operation request.

Torque output from the automatic transmission 208 may in turn be relayed to wheels 216 to propel the vehicle via transmission output shaft 234. Specifically, automatic transmission 208 may transfer an input driving torque at the input shaft 236 responsive to a vehicle traveling condition before transmitting an output driving torque to the wheels.

Further, a frictional force may be applied to wheels 216 by engaging wheel brakes 218. In one example, wheel brakes 218 may be engaged in response to the driver pressing his foot on a brake pedal (not shown). In the same way, a frictional force may be reduced to wheels 216 by disengaging wheel brakes 218 in response to the driver releasing his foot from a brake pedal. Further, vehicle brakes may apply a frictional force to wheels 216 as part of an automated engine stopping procedure.

A mechanical oil pump 214 may be in fluidic communication with automatic transmission 208 to provide hydraulic pressure to engage various clutches, such as forward clutch 210 and/or torque converter lock-up clutch 212. Mechanical oil pump 214 may be operated in accordance with torque converter 212, and may be driven by the rotation of the engine or transmission input shaft, for example. Thus, the hydraulic pressure generated in mechanical oil pump 214 may increase as an engine speed increases, and may decrease as an engine speed decreases. An electric oil pump 220, also in fluidic communication with the automatic transmission but operating independent from the driving force of engine 10 or transmission 208, may be provided to supplement the hydraulic pressure of the mechanical oil pump 214. Electric oil pump 220 may be driven by an electric motor (not shown) to which an electric power may be supplied, for example by a battery (not shown).

Transmission input speed may be monitored via transmission input shaft speed sensor 240. Transmission output speed may be monitored via transmission output shaft speed sensor 244. In some examples, accelerometer 250 may provide vehicle acceleration data to controller 12 so that gear clutches 210 and 230 may be controlled via valves 280-286 during engine starting and vehicle launch.

A controller 12 may be configured to receive inputs from engine 10, as shown in more detail in FIG. 1, and accordingly control a torque output of the engine and/or operation of the torque converter, transmission, clutches, and/or brakes. As one example, a torque output may be controlled by adjusting a combination of spark timing, fuel pulse width, fuel pulse timing, and/or air charge, by controlling air inlet throttle opening and/or valve timing, valve lift and boost for turbo- or super-charged engines. In the case of a diesel engine, controller 12 may control the engine torque output by controlling a combination of fuel pulse width, fuel pulse timing, and air charge. In all cases, engine control may be performed on a cylinder-by-cylinder basis to control the engine torque output.

When idle-stop conditions are satisfied, controller 12 may initiate engine shutdown by shutting off fuel and spark to the engine. A wheel brake pressure may also be adjusted during the engine shutdown, based on the clutch pressure, to assist in limiting vehicle motion.

When engine restart conditions are satisfied, and/or a vehicle operator wants to launch the vehicle, controller 12 may reactivate the engine by resuming cylinder combustion. To launch the vehicle, transmission 208 may be unlocked and the wheel brakes 218 may be released, to return torque to the driving wheels 216. A clutch pressure may be adjusted to unlock the transmission via valves 280-286, while a wheel brake pressure may be adjusted to coordinate the release of the brakes with the unlocking of the transmission, and a launch of the vehicle.

Thus, the system of FIGS. 1 and 2 provides for a system for controlling an engine, comprising: an engine including a crankshaft; an exhaust system coupled to the engine, the exhaust system including an emissions control device; an electric energy conversion device supplying a torque to the crankshaft; and a controller including executable instructions stored in a non-transitory medium to delay shutdown of the engine in response to a state of the emissions control device during an automatic engine stop.

In one example, the system includes where the controller includes further instructions to adjust current supplied to the electric energy conversion device in response to a state of the emissions control device at a time of an engine stop request. The system also includes where the controller includes further instructions to provide the engine stop request. The system includes where the controller includes further instructions to adjust a position of an air inlet throttle in response to the state of the emissions control device. The system also includes where the controller includes further instructions to adjust a state of the emissions control device to a desired state during the automatic engine stop, and where the automatic engine stop includes a time from a request to stop the engine to when the engine stops rotating.

Referring now to FIG. 3, a simulated example plot of different engine speed profiles in response to a request to stop an engine is shown. FIG. 3 also includes simulated current profiles supplied to an electric energy conversion device that provides torque to stop the engine. The engine speed profiles of FIG. 3 may be provided by controller 12 of FIG. 1 executing instructions of the methods of FIGS. 5 and 6.

The plot shows engine speed in the direction of the Y axis and engine speed increases in the direction of the Y axis arrow. The plot includes a second Y axis representing field current of an electric energy conversion device. Field current increases in the direction of the Y axis arrow. The X axis represents time and time increases from the left side of the figure to the right side of the figure. Vertical markers indicate times of interest at $T_1$-$T_3$. A first engine speed trajectory is indicated by curve 302. A second engine speed trajectory is indicated by curve 304. Field current supplied to the electric energy conversion device for the engine speed trajectory curve 302 is indicated by curve 306. Field current supplied to the electric energy conversion device for the engine speed trajectory curve 304 is indicated by curve 308.

At time $T_0$, the engine is operating at a steady speed, idle speed for example, and no engine stop request has been asserted. Further, field current is at a low level. An engine stop request is generated at time $T_1$. If an amount of oxygen stored in a catalyst is greater than a threshold, engine speed is controlled during the engine stop along the trajectory indicated by curve 302. Thus, engine speed is reduced at a greater rate as compared with curve 304. Accordingly, less air may be pumped through the engine to the catalyst as the engine stops. The same trajectory of curve 302 may be taken by the engine when the catalyst has an oxygen storage capacity less than a threshold level, when catalyst temperature is less than a threshold temperature for example. Note that catalyst oxygen storage capacity may vary with catalyst temperature. On the other hand, if the catalyst has an oxygen storage capacity greater than a threshold, and less than a threshold amount of oxygen is stored by the catalyst, engine speed may take the trajectory of curve 304. Thus, additional oxygen may be pumped by the engine to the catalyst when the catalyst has a high oxygen storage capacity and while less than a threshold amount of oxygen is stored within the catalyst.

It can be observed that the time duration from time $T_1$ to time $T_2$ (when engine speed is zero for curve 302) is shorter than the time duration from time $T_1$ to time $T_3$ (when the engine speed is zero for curve 304). By shortening the time of engine rotation it may be possible to reduce the amount of oxygen pumped by the engine to the catalyst. Conversely, increasing the amount of time the engine rotates can increase the amount of oxygen that is pumped by the engine to the catalyst. Additionally, the amount of air pumped to the catalyst may be further controlled via changing a position of a throttle or intake and exhaust valve opening and closing timing. For example, additional oxygen may be pumped to the catalyst via opening the throttle. Less oxygen may be pumped to the catalyst via closing the throttle. It can also be observed that engine speed of curves 302 and 304 begin to be reduced at the same time after time $T_1$; however, the time that engine speed reaches zero between the two curves is different.

The engine speeds of curves 302 and 304 are adjusted via controlling torque applied to the engine via an electric machine. In one example, a starter is engaged and field current is adjusted to as indicate by curves 306 and 308 to vary torque provided to the engine via the starter. The current is shown starting at a low level and increasing with time. In other examples, the current may be initiated at a high level and be reduced with time. Similarly, field current of a starter/ alternator or a motor/generator may be adjusted to increase or decrease engine stopping time (e.g., the amount of time from an engine stop request to a time when engine speed is zero).

Referring now to FIG. 4, an alternative engine stopping trajectory in response to a request to stop an engine is shown. The engine speed profiles of FIG. 4 may be provided by controller 12 of FIG. 1 executing instructions of the methods of FIGS. 5 and 6.

The plot shows engine speed in the direction of the Y axis and engine speed increases in the direction of the Y axis arrow. A second Y axis is provided to show an amount of field current provided to an electric energy conversion device. The field current increases in the direction of the Y axis arrow. The X axis represents time and time increases from the left side of the figure to the right side of the figure. Vertical markers indicate times of interest at $T_1$-$T_3$. An engine speed trajectory is indicated by curve 402.

At time $T_0$, the engine is operating at a desired speed, idle speed for example, and there is no request to stop the engine. Further, field current supplied to the electric energy conversion device is at a low level. At time $T_1$, a request to stop the engine is made. The engine stop request may be based on vehicle conditions such as engine speed, vehicle speed, and whether or not a brake pedal is depressed. However, in this example, the engine stop is delayed so that the engine can be operated while the state of the catalyst is adjusted via varying fuel injection. For example, if more than a threshold amount of oxygen is stored in the catalyst, an amount of fuel injected to the engine can be increased to enrich the engine air-fuel mixture. Alternatively, if less than a threshold amount of oxygen is stored in the catalyst, an amount of fuel injected to the engine can be decreased to lean the engine air-fuel mixture. In this way, the state of the catalyst may be adjusted before the fuel and/or spark are deactivated. The time between time $T_1$ and time $T_2$ is the time in this example to adjust the state of the catalyst in response to the engine stop request. The delay time may be a predetermined amount of time or it may be an amount of time that it takes for the catalyst to reach a desired state as indicated by an oxygen sensor. For example, the engine may operate rich or lean until an output of an oxygen sensor reaches a threshold level.

At time $T_2$, the catalyst has reached a desired state. As a result, spark and fuel are deactivated and the engine is stopped. Further, the field current supplied to the electric energy conversion device indicated by curve 404 increases to increase torque applied to the engine crankshaft. Thus, the trajectory of engine speed is controlled by adjusting torque applied to the engine crankshaft via an electric energy conversion device (e.g., a generator). In this way, engine stopping may be delayed until a catalyst reaches a desired state, and then engine speed may be controlled after the delay and during engine shutdown to ensure the catalyst remains in a desired state when engine speed reaches zero speed.

It should be noted that the desired catalyst state and engine speed trajectory during engine stopping may be adjusted for operating conditions. For example, the engine may be allowed to rotate for a longer period of time when the catalyst temperature is greater than a threshold. Similarly, the engine may be allowed to rotated for a longer period of time when engine temperature is greater than a threshold temperature.

Figure 5:
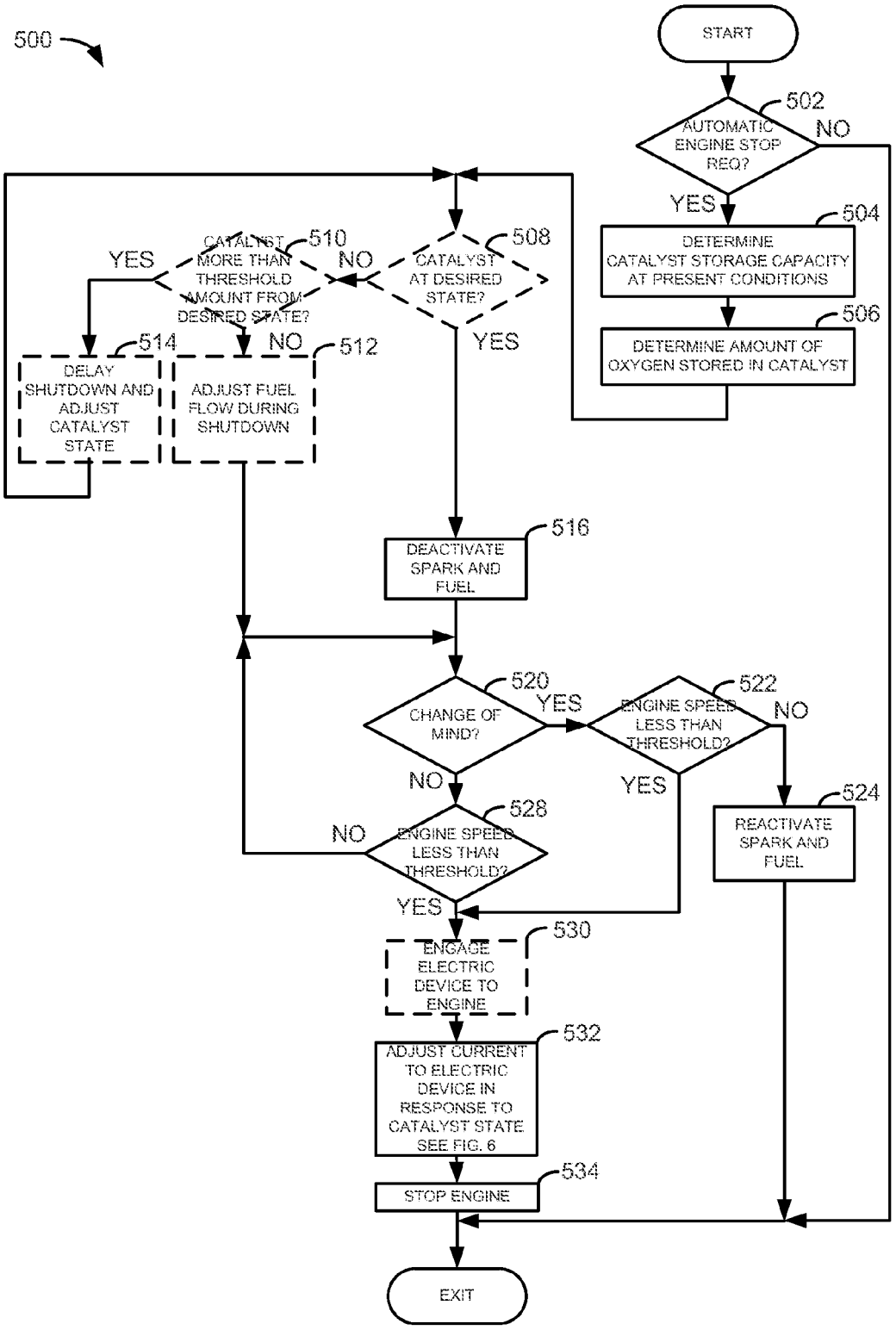
FIGS. 5 and 6 are flowcharts of an example engine stopping method.

Referring now to FIG. 5, a flowchart of an example engine stopping method is shown. The method of FIG. 5 may be executed via instructions stored in non-transitory memory of a controller such as is described in FIGS. 1 and 2. The method of FIG. 5 may provide the engine stopping sequences described in FIGS. 3 and 4.

At 502, method 500 judges whether or not an automatic engine stop request is present. In other examples, method 500 may proceed to 504 any time an engine stop request is generated independent of whether the engine stop request is generated by a driver or automatically by a controller. An automatic engine stop request may be asserted when selected operating conditions are present. For example, an automatic engine stop request may occur when vehicle speed is zero, when engine idle speed is reached, and when a brake pedal is depressed. If method 500 judges that an automatic engine stop request is present, the answer is yes and method 500 proceeds to 504. Otherwise, the answer is no and method 500 proceeds to exit.

At 504, method 500 determines an oxygen storage capacity of a catalyst at the time of the engine stop request. In one example, a catalyst storage capacity is determined according to the method described in U.S. Pat. No. 6,453,662 which is hereby incorporated by reference for all intents and purposes. Thus, in one example, catalyst storage capacity is estimated based on catalyst temperature and washcoat properties. In particular, temperatures of catalyst bricks are used to index tables or functions that output catalyst oxygen storage capacity in response to catalyst temperature. The output of the tables or functions may be adjusted for catalyst degradation. The oxygen storage capacity of each catalyst brick is summed with the oxygen storage capacity of other catalyst bricks in the engine exhaust system to provide a total oxygen storage capacity of the engine exhaust system. Method 500 proceeds to 506 after oxygen storage capacity of the exhaust system is determined.

At 506, method 500 determines an amount of oxygen stored in the engine exhaust system. In one example, an amount of oxygen stored in the engine exhaust system is determined according to the method described in U.S. Pat. No. 6,453,662. In particular, an amount of oxygen flowing into the exhaust system is estimated according to the following equation:

$$O_2 = A[1-\psi)\cdot(1+y/4)]\cdot 32$$

Where $O_2$ is the amount of oxygen flowing into the exhaust system, $\Psi$ is the combusted air-fuel mixture ratio, and where y is a variable that is dependent on properties of the combusted fuel. The value of y for gasoline is 1.85. A represents a mole flow rate of air in the exhaust manifold 48 and is estimated according to the following equation:

$$A = \frac{1}{(1+y/4)((\mathrm{MWO})_2 + \mathrm{MWN}_2 + 3.76)}$$

Where $MWO_2$ is the molecular weight of oxygen (32), $MWN_2$ is the molecular weight of nitrogen (28), and y is a value that varies with properties of the combusted fuel. The change in oxygen storage in the catalyst is expressed as for oxygen being adsorbed:

$$\Delta O_2 = C_1 * C_2 * C_3 * C_4\left[Ka * \left(1 - \frac{\mathrm{storedO2}}{\mathrm{max\,O2}}\right)^{N_1} * \left(\frac{\mathrm{O2}\ flowrate}{basevalue}\right)^{z_1}\right) * Catvol * \Delta T$$

The change in oxygen storage in the catalyst is expressed as for oxygen being desorbed:

$$\Delta O_2 = C_1 * C_2 * C_3 * C_4\left[Kd * \left(\frac{\mathrm{storedO2}}{\mathrm{max\,O2}}\right)^{N_2} * \left(\frac{\mathrm{O2}\ flowrate}{basevalue}\right)^{z_2}\right) * Catvol * \Delta T$$

Where $C_1$-$C_3$ are variables dependent on catalyst characteristics, $C_4$ is an adaptive parameter that provided a feedback adjustment to the estimated oxygen level, Kd and Ka are catalyst desorption and adsorption rates, ΔT is change in catalyst temperature, max $O_2$ is the maximum storage capacity of the catalyst, stored $O_2$ is the present amount of stored oxygen, Catvol is catalyst volume, and $N_1$, $N_2$, $Z_1$, and $Z_2$ are experimentally determined exponents that express the probability of adsorption and desorption. An initial oxygen storage amount of the catalyst is estimated based on catalyst operating conditions at the time of engine starting, then the change in oxygen is added to the estimate to provide an amount of oxygen stored in the catalysts of the exhaust system. Method 500 proceeds to 508 after an estimated amount of oxygen stored in the catalysts is determined.

At 508, method 500 judges whether or not the catalyst in a desired operating state. In one example, the desired operating state may include a desire catalyst oxygen storage capacity and a desired amount of oxygen stored in the catalyst. The desired catalyst oxygen storage capacity may be adjusted for engine and vehicle operating conditions. For example, the desired oxygen storage capacity may increase as engine temperature and operating time increase. Similarly, the desired amount of oxygen stored may vary with operating conditions. For example, the desired amount of stored oxygen may decrease with increasing engine temperature. If method 500 determines that the catalyst is at a desired operating state, the answer is yes and method 500 proceeds to 516. Otherwise, the answer is no and method 500 proceeds to 510.

At 510, method 500 judges whether or not the catalyst is more than a threshold amount from the desired catalyst state. For example, if the catalyst is at an oxygen storage capacity less than a threshold, the answer is yes and method 500 proceeds to 514. In another example, if the catalyst is storing more than a threshold amount of oxygen, the answer is yes and method 500 proceeds to 514. In still another example, if the catalyst oxygen storage amount is less than a desired amount of oxygen, the answer is yes and method 500 proceeds to 514. If method 500 judges the catalyst is more than a threshold amount from a desired state, the answer is yes and method 500 proceeds to 514. Otherwise, the answer is no and method 500 proceeds to 512.

At 514, method 500 delays engine shutdown (e.g., deactivation of fuel and/or spark). The amount of the delay may vary depending on how long it takes for the state of the catalyst to reach a desired state. For example, if the oxygen storage capacity of the catalyst is less than desired, the engine may be operated until the desired oxygen storage capacity of the catalyst is reached. Similarly, if more than a desired amount of oxygen is stored in the catalyst, the engine may be operated until the amount of oxygen stored in the catalyst is reduced to a desired level. In other words, operation of the engine may continue until the catalyst reaches desired operating conditions.

The state of the catalyst may be adjusted in several ways. For example, the amount of oxygen stored in the catalyst can be increased via leaning an air-fuel mixture supplied to the engine or via injecting air into the exhaust system. The amount of oxygen stored in the catalyst may be reduced via richening the air-fuel mixture supplied to the engine. The oxygen storage capacity of the catalyst may be increased via increasing the temperature of the catalyst. In one example, the catalyst temperature is increased via retarding spark timing and increasing engine air flow. The catalyst oxygen storage capacity can be reduced via advancing spark timing and decreasing engine air flow. Method 500 returns to 508 after adjustments are made to change the catalyst state.

At 512, method 500 adjusts fuel amount and air amount when the engine is shutdown. In one example, injection of fuel to engine cylinders for combustion in the cylinders is deactivated in response to an engine stop request. However, additional fuel may be injected late (e.g., during the exhaust stroke of a cylinder after ignition) to adjust the amount of air stored in the catalyst during the engine shutdown. In other examples, the amount of air entering engine cylinders during engine shutdown may be increased or decreased depending on the amount of oxygen stored in the catalyst. For example, if the amount of oxygen stored in the catalyst is less than desired, the throttle may be opened to increase air flow through the engine. If the amount of oxygen stored in the catalyst is greater than desired, the throttle may be closed further to decrease air flow through the engine. In these ways, the state of a catalyst may be adjusted in response to an engine stop request during an engine shutdown. The adjustments at 512 may be made before or after spark and or fuel supplied to the cylinder are deactivated for combustion in the cylinder. Method 500 proceeds to 518 after adjustments to alter the state of the catalyst are performed.

At 516, method 500 deactivates spark and/or fuel supplied to the engine to stop the engine. Spark and fuel may be deactivated immediately in response to a request to stop the engine, in the middle of injection or a spark event for example. Alternatively, spark and fuel may be deactivated after any fuel injection events that are in progress are completed. Method 500 proceeds to 520 after spark and/or fuel are deactivated to the cylinder.

At 520, method 500 judges whether or not there is an operator change of mind condition present after spark and/or fuel are deactivated. A change of mind condition may be present when a driver releases a brake pedal after spark and fuel delivery to the engine is deactivated. Releasing the brake may be an indication of the driver's intent to resume driving the vehicle. If a change of mind is determined by method 500, the answer is yes and method 500 proceeds to 522. If a change of mind is not determined by method 500, the answer is no and method 500 proceeds to 528.

At 522, method 500 judges whether or not engine speed is less than a desired threshold. The desired threshold may be an engine speed where it is not desirable to restart the engine without aid of a motor or starter. For example, if engine speed is less than 350 RPM it may not be desirable to restart the engine without assistance from a motor. Thus, in this example, 350 RPM is the threshold speed. If engine speed is less than a threshold speed, the answer is yes and method 500 proceeds to 530. Otherwise, the answer is no and method 500 proceeds to 524.

At 524, method 500 reactivates spark and fuel supplied to the engine and the engine is restarted. Further, throttle position may be adjusted to increase the amount of air entering the engine so that additional torque may be provided by the engine. In examples where the state of the catalyst is such that an amount of oxygen stored in the catalyst is less than a threshold amount, fuel and spark reactivation may be delayed until engine speed is less than a threshold speed or until a desired amount of air is pumped through the engine. Thus, by delaying engine reactivation, the state of the catalyst may be more quickly adjusted to a desired state. Such operation may be particularly useful when an engine air-fuel mixture is richened in response to an engine stop request in preparation for pumping air through the engine. As a result, the richening of the air-fuel mixture during engine shutdown can be counteracted by flowing air to the catalyst before the engine is restarted by reactivating spark and fuel. Method 500 proceeds to exit after the engine is restarted.

At 528, method 500 judges whether or not engine speed is less than a threshold. The threshold engine speed may vary depending on engine operating conditions and based on the configuration of a motor/alternator that may apply torque to the engine's crankshaft. For example, method 500 may proceed to 530 if engine speed is less than 300 RPM when an electric motor/alternator engaged to the engine via a pinion is available to apply torque to the engine's crankshaft. Alternatively, if a motor/alternator is coupled to the crankshaft directly or via a belt, the motor/alternator may begin applying torque to the engine crankshaft at a higher engine speed threshold, 800 RPM for example. Thus, the threshold engine speed at 528 may be 800 RPM or higher in some examples. If method 500 judges that engine speed is less than a threshold engine speed, the answer is yes and method 500 proceeds to 530. Otherwise, the answer is no and method 500 returns to 520.

At 530, method 500 engages an electric energy conversion device (e.g., a motor/alternator) to the engine to apply torque to the engine. Step 530 may be omitted if the electric energy conversion device is coupled to the engine via a belt or a direct coupling. In one example, a pinion engages the electrical energy conversion device to the engine. Method 500 proceeds to 532 after the electric energy conversion device is engaged with the motor.

Figure 6:
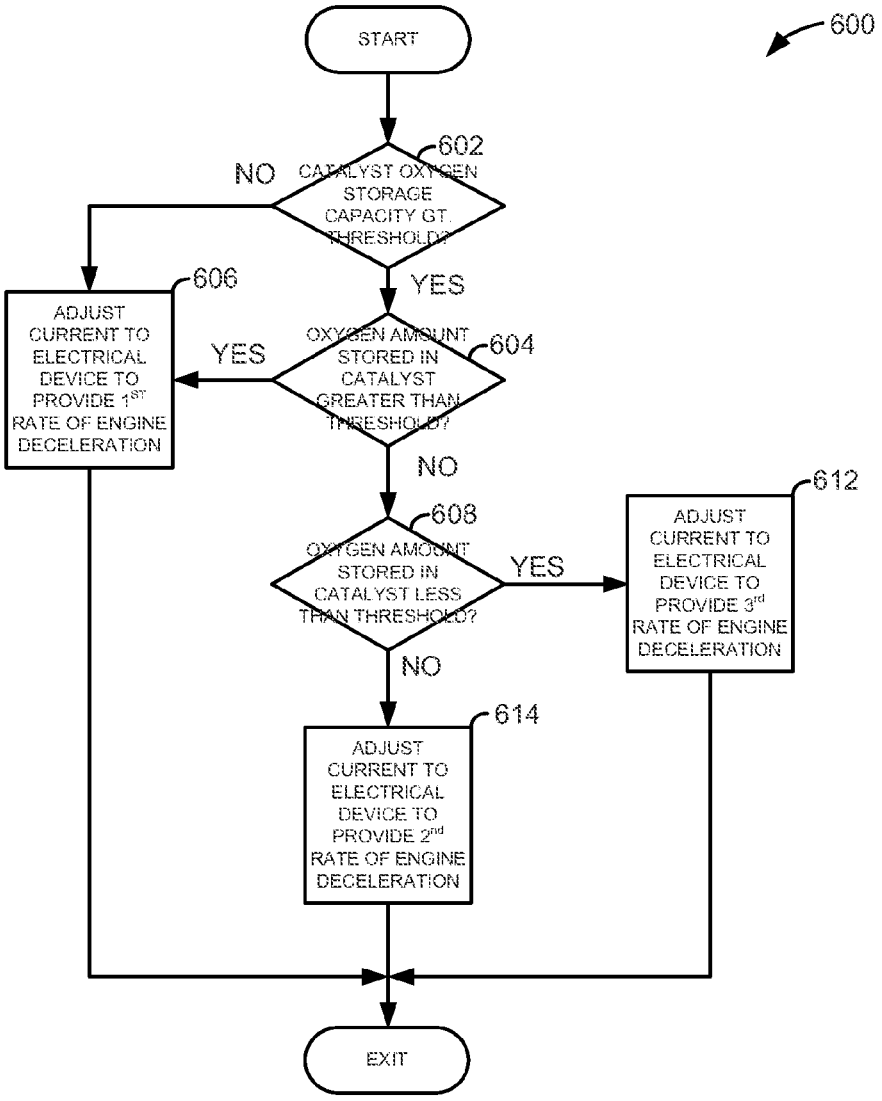

At 532, method 500 adjusts current supplied to the electric energy conversion device in response to catalyst state. In one example, current may be supplied to the electric energy conversion device at a first rate when the oxygen storage capacity of the catalyst is less than a first threshold amount. Current may be supplied to the electric energy conversion device at a second rate when the oxygen storage capacity of the catalyst is greater than a second threshold amount. And, the first current rate may be higher than the second current rate. Thus, when the oxygen storage capacity of the catalyst is greater than a first threshold, current may be supplied to a field coil of the alternator at a first rate to reduced engine speed at a first rate. When oxygen storage capacity of the catalyst is less than a second threshold, the second threshold less than the first threshold, current may be supplied to the field coil of the alternator at a second rate, the second current rate greater than the first current rate. In this way, engine speed is reduced at a second rate when catalyst oxygen storage capacity is low, the second engine speed reduction rate greater than the first engine speed reduction rate. FIG. 6 provides additional details for adjusting current supplied to the electrical energy conversion device assisting engine stopping. Method 500 proceeds to 534 after current supplied to the electric energy conversion device is adjusted.

At 534, the engine is brought to a stopped state by the electric motor/alternator applying torque to the engine crankshaft. In some examples, the same electric motor/alternator may assist restarting the engine via applying torque to the engine when an engine restart is requested. Method 500 proceeds to exit after the engine is stopped.

Referring now to FIG. 6, a flowchart of an example control method for an electric energy conversion device is shown. The method of FIG. 6 may be executed via instructions stored in non-transitory memory of a controller such as is described in FIGS. 1 and 2. The method of FIG. 6 may provide the engine stopping sequences described in FIGS. 3 and 4 and may operate in conjunction with the method of FIG. 5.

At 602, method 600 judges whether or not catalyst oxygen storage capacity is greater than a threshold capacity. The threshold capacity may vary based on engine operating conditions. For example, the threshold capacity may increase as engine operating temperature increases. If method 600 judges that catalyst oxygen storage capacity at the time of the engine stop request is greater than the threshold, the answer is yes and method 600 proceeds to 604. Otherwise, the answer is no and method 600 proceeds to 606.

At 606, method 600 adjusts current supplied to an electric energy conversion device to a first rate to decelerate the engine at a first rate. In some examples the first current rate may be a constant. In other examples, the first current rate may vary as the amount of time the current is applied to the electric energy conversion device increases until the engine stops rotating. For example, the amount of current supplied to the electric energy conversion device may increase as an amount of time the current is applied to the electric energy conversion device increases. In one example, the amount of current supplied to the electric energy conversion device at the first rate is higher than an amount of current supplied to the electric energy conversion device at second and third rates of current supplied. The electric energy conversion device may stop the engine sooner (e.g., in a shorter time between the engine stop request and zero engine speed) when a higher amount of current is supplied to the electric energy conversion device (e.g., a higher field current). Thus, the engine may decelerate at a higher rate when a higher current is applied to the electric energy conversion device. Method 600 proceeds to exit after current is supplied to the electric energy conversion device at the first rate.

At 604, method 600 judges whether or not an amount of oxygen stored in the catalyst is greater than a threshold amount. If so, the answer is yes and method 600 proceeds to 606. Otherwise, the answer is no and method 600 proceeds to 608.

At 608, method 600 judges whether or not an amount of oxygen stored in a catalyst is less than a threshold amount. If so, the answer is yes and method 600 proceeds to 612. Otherwise, the answer is no and method 600 proceeds to 614.

At 614, method 600 adjusts current supplied to the electric energy conversion device to a second rate in order to decelerate the engine at a second rate. In some examples the second current rate may be a constant and less than the first rate at 606. In other examples, the second current rate may vary as the amount of time the current is applied to the electric energy conversion device increases until the engine stops rotating. For example, the amount of current supplied to the electric energy conversion device may increase as an amount of time the current is applied to the electric energy conversion device increases. In one example, the amount of current supplied to the electric energy conversion device at the second rate is higher than an amount of current supplied to the electric energy conversion device at a third rate of current supplied. In still other examples, the amount of current supplied to the electric energy conversion device may follow a predetermined profile that supplies current at a lower level than the first rate at 606. Thus, the engine may decelerate at a lower rate of speed when a middle level of current is applied to the electric energy conversion device. Method 600 proceeds to exit after current is supplied to the electric energy conversion device at the second rate.

At 612, method 600 adjusts current supplied to the electric energy conversion device to a third rate in order to reduce engine speed at a third rate. In some examples the third current rate may be a constant and less than the second rate at 614. In other examples, the third current rate may vary as the amount of time the current is applied to the electric energy conversion device increases until the engine stops rotating. In one example, the amount of current supplied to the electric energy conversion device at the third rate is lower than an amount of current supplied to the electric energy conversion device at the first and second rates of current supplied. In still other examples, the amount of current supplied to the electric energy conversion device may follow a predetermined profile that supplies current at a lower level than the second rate at 614. Thus, the engine may decelerate at a lower rate of speed when a lower level of current is applied to the electric energy conversion device. Method 600 proceeds to exit after current is supplied to the electric energy conversion device at the third rate.

In this way, current supplied to an electric energy conversion device applying torque to an engine crankshaft can be adjusted according to the operating state of a catalyst. Further, current may be adjusted to the electric energy conversion device in response to the oxygen storage capacity of the catalyst and the amount of oxygen stored within the catalyst.

Thus, the method of FIGS. 5 and 6 provides for a method for operating an engine, comprising: shutting down an engine; and adjusting current supplied to an electric energy conversion device applying torque to a crankshaft of the engine in response to an oxygen storage capacity of a catalyst at a time of shutting down the engine. The time of shutting down the engine may begin with the time spark and fuel are deactivated or alternatively at a time when an engine stop request is initially requested. In other examples, time of engine shutdown may begin after a last combustion event after a request to stop the engine. The method includes where the electric energy conversion device is a starter including a pinion that engages when engine speed is less than a threshold speed. The method also includes where the electric energy conversion device is an electric motor mechanically coupled to the crankshaft. In this way, the time duration it takes to stop the engine from rotating after an engine stop request can be adjusted in response to a state of the catalyst.

The method includes where current supplied to the electric energy conversion device is adjusted to a first current amount when the oxygen storage capacity of the catalyst is greater than a first oxygen storage capacity, where current supplied to the electric energy conversion device is adjusted to a second current amount when the oxygen storage capacity of the catalyst is less than a second oxygen storage capacity, where the first current amount is less than the second current amount, and where the second oxygen storage capacity is less than the first oxygen storage capacity. Thus, in one example, current supplied to the electric energy conversion device increases as an oxygen storage capacity of a catalyst decreases.

The method includes where the engine is shutdown via deactivating spark or fuel flow to the engine. The method further comprises reactivating the engine at a time after engine shutdown and before engine stop in response to a change of mind request and a state of the catalyst. The method includes where adjusting current supplied to the electric energy conversion device includes increasing an amount of current supplied to the electric energy conversion device as the oxygen storage capacity of the catalyst is reduced.

The method of FIGS. 5 and 6 also provides for a method for operating an engine, comprising: shutting down an engine; and adjusting current supplied to an electric energy conversion device applying torque to a crankshaft of the engine in response to an amount of oxygen stored within a catalyst at a time of shutting down the engine. The method further comprises adjusting a position of an air inlet throttle in response to shutting down the engine and the amount of oxygen stored within the catalyst. The method includes where adjusting current supplied to the electric energy conversion device includes increasing an amount of current supplied to the electric energy conversion device as an amount of oxygen stored in the electric energy conversion device increases. The method further comprises delaying shutting down the engine after a request to stop the engine in response to an oxygen storage capacity of the catalyst.

In some examples, the method includes where engine shutdown is delayed until the catalyst is operating at a desired state. The method further comprises delaying shutting down the engine after a request to stop the engine in response to an amount of oxygen stored within the catalyst. The method includes where engine shutdown is delayed until the catalyst is operating at a desired state. The method includes where an amount of air or fuel supplied to the engine is adjusted to direct the catalyst to the desired state.

As will be appreciated by one of ordinary skill in the art, routines described in FIGS. 5 and 6 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method, comprising:

shutting down an engine; and adjusting current supplied to an electric energy conversion device applying torque to a crankshaft of the engine in response to an oxygen storage capacity of a catalyst at a time of shutting down the engine, where current supplied to the electric energy conversion device is adjusted to a first current amount when the oxygen storage capacity of the catalyst is greater than a first oxygen storage capacity, where current supplied to the electric energy conversion device is adjusted to a second current amount when the oxygen storage capacity of the catalyst is less than a second oxygen storage capacity, where the first current amount is less than the second current amount, and where the second oxygen storage capacity is less than the first oxygen storage capacity.

2. A method, comprising:

shutting down an engine; and adjusting current supplied to an electric energy conversion device applying torque to a crankshaft of the engine in response to an oxygen storage capacity of a catalyst at a time of shutting down the engine, where the electric energy conversion device is a starter including a pinion that engages when engine speed is less than a threshold speed.

3. The method of claim 1, where the electric energy conversion device is an electric motor mechanically coupled to the crankshaft.

4. The method of claim 1, where the engine is shutdown via deactivating spark or fuel flow to the engine.

5. The method of claim 4, further comprising reactivating the engine at a time after engine shutdown and before engine stop in response to a change of mind request and a state of the catalyst.

6. A method, comprising:

shutting down an engine; and adjusting current supplied to an electric energy conversion device applying torque to a crankshaft of the engine in response to an oxygen storage capacity of a catalyst at a time of shutting down the engine, where adjusting current supplied to the electric energy conversion device includes increasing an amount of current supplied to the electric energy conversion device as the oxygen storage capacity of the catalyst is reduced.

7. A method, comprising:

shutting down an engine; and adjusting current supplied to an electric energy conversion device applying torque to a crankshaft of the engine in response to an amount of oxygen stored within a catalyst at a time of shutting down the engine, where adjusting current supplied to the electric energy conversion device includes increasing an amount of current supplied to the electric energy conversion device as an amount of oxygen stored in the electric energy conversion device increases.

8. The method of claim 7, further comprising adjusting a position of an air inlet throttle in response to shutting down the engine and the amount of oxygen stored within the catalyst.

9. The method of claim 7, further comprising delaying shutting down the engine after a request to stop the engine in response to an oxygen storage capacity of the catalyst.

10. The method of claim 9, where engine shutdown is delayed until the catalyst is operating at a desired state.

11. The method of claim 7, further comprising delaying shutting down the engine after a request to stop the engine in response to an amount of oxygen stored within the catalyst.

12. The method of claim 11, where engine shutdown is delayed until the catalyst is operating at a desired state.

13. The method of claim 12, where an amount of air or fuel supplied to the engine is adjusted to direct the catalyst to the desired state.

14. A method, comprising:

shutting down an engine; and adjusting current supplied to an electric energy conversion device applying torque to a crankshaft of the engine in response to an oxygen storage capacity of a catalyst at a time of shutting down the engine, wherein adjusting current includes, when an oxygen storage amount is greater than a first threshold, adjusting current to provide a first rate of engine deceleration, and when the oxygen storage amount is not greater than the first threshold, providing a second rate of engine deceleration in response to the oxygen storage amount not less than a second threshold and providing a third rate of engine deceleration in response to the oxygen storage amount less than the second threshold, the third rate lower than the second rate, the second rate lower than the third rate.

15. The method of claim 1, wherein the oxygen storage capacity is estimated based on catalyst temperature.

16. The method of claim 7, further comprising determining delaying shutdown of the engine in response to a state of an emissions control device during an automatic engine stop, the state of the emissions control device including a determined oxygen storage level in the emissions control device as compared to a desired oxygen storage level, and adjusting a position of an air inlet throttle in response to the state of the emissions control device while shutting down the engine.

17. The method of claim 6, further comprising delaying the shutdown based on catalyst temperature, including rotating the engine for a longer period of time when the catalyst temperature is greater than a threshold.

18. the method of claim 6, where the electric energy conversion device is an electric motor mechanically coupled to the crankshaft.

19. The method of claim 7, wherein an oxygen storage capacity is estimated based on catalyst temperature for determining the amount of oxygen stored within the catalyst.

* * * * *